United States Patent [19]

Dudley et al.

[11] 4,135,465

[45] Jan. 23, 1979

[54] TANK FOR FUEL TANKER

[76] Inventors: Fred T. Dudley, George Spector, both c/o 3615 Woolworth Bldg., 233 Broadway, New York, N.Y. 10007

[21] Appl. No.: 758,465

[22] Filed: Jan. 11, 1977

[51] Int. Cl.[2] ..... B63B 25/08

[52] U.S. Cl. ..... 114/74 A; 220/901

[58] Field of Search ..... 114/74 R, 74 A, 75, 114/69; 220/9 A, 9 F, 9 LG, 15

[56] References Cited

U.S. PATENT DOCUMENTS

| | | | |
|---|---|---|---|
| 2,404,418 | 7/1946 | Walker | 114/74 A |
| 2,859,711 | 11/1958 | Track | 114/74 A |
| 3,272,373 | 9/1966 | Alleaume et al. | 220/9 LG |
| 3,566,824 | 3/1971 | Cuneo et al. | 114/74 A |
| 3,576,270 | 4/1971 | Larsen | 220/15 |
| 3,927,788 | 12/1975 | Zinniger et al. | 114/74 A |
| 3,929,247 | 12/1975 | Borup | 114/74 A |

FOREIGN PATENT DOCUMENTS

| | | | |
|---|---|---|---|
| 1434942 | 3/1966 | France | 114/74 A |

*Primary Examiner*—Stephen G. Kunin

[57] ABSTRACT

An oil tank which is inserted into a hold of an oil tanker vessel; the oil tank being smaller than the space in the hold so that there is approximately a three inch clearance all around the sides and bottom of the tank, this space being filled with a sprayed in foam.

1 Claim, 3 Drawing Figures

TANK FOR FUEL TANKER

This invention relates generally to oil tanker vessels.

A principal object of the present invention is to provide a material for insertion into a space between the walls and floor of a ship hold and the walls and bottom of an oil tank that is fitted into the hold, the material filling the space therebetween so to firmly support the tank.

Another object is to provide a material which will add protection to the tank against becoming loosened inside the hold and thus be subject to becoming damaged if striking against the bulkhead or damaging the bulkhead as well.

Still another object is to provide a material which will shut away air from around the tank, thus promoting safety against development of a fire in this area.

Aother objects are to provide a tank for an oil tanker surrounded by a material comprised of sprayed in foam that can readily be installed into the space between the tank and the hold walls and floor; the tank being an inverted fuel tank such as is used in aircraft.

Other objects are to provide a tank for fuel tanker which is simple in design, inexpensive to manufacture, rugged in construction, easy to use and efficient in operation.

These and other objects will be readily evident upon a study of the following specification and the accompanying drawing wherein.

Figure 1:
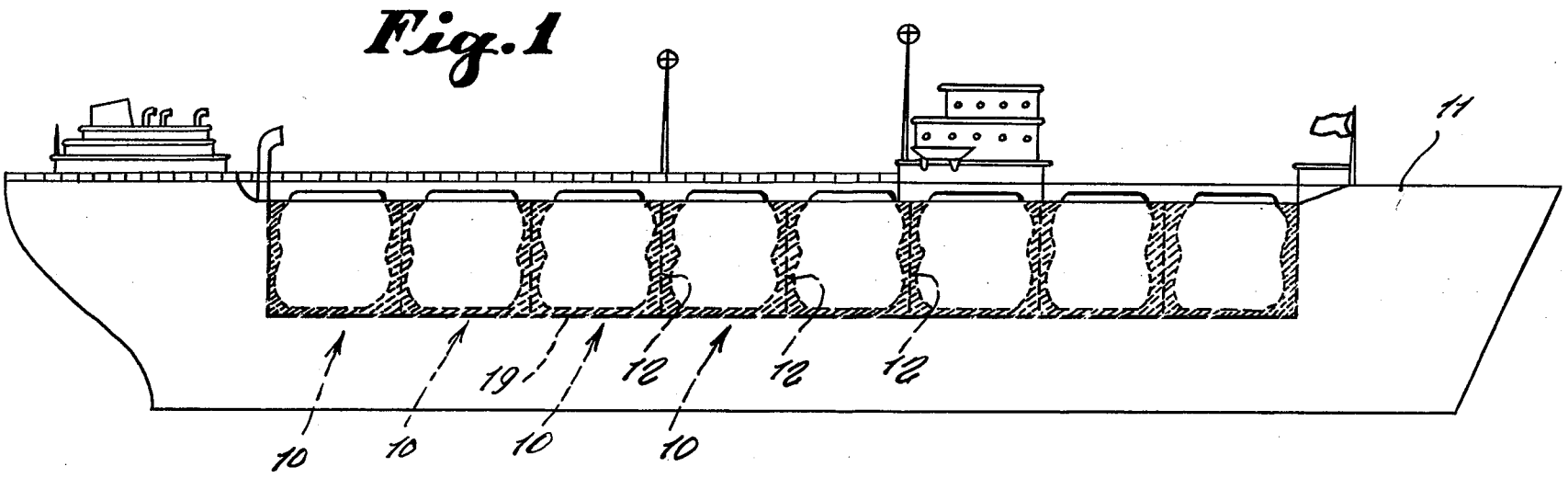
FIG. 1 is a side view of a fuel oil tanker shown carrying a row of oil tanks each of which is fitted into a ship hold and surrounded by a spray foam.
Figure 2:
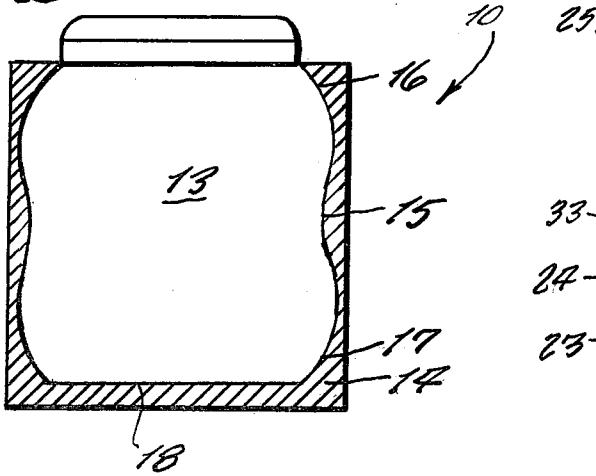
FIG. 2 is an enlarged transverse cross-section of one of the spray foam supports around one of the oil tanks.

Referring now to the drawing in detail, and more particularly to FIGS. 1 and 2 thereof, at this time, the reference numeral 10 represents a tank assembly for an oil tanker vessel 11 according to the present invention. The vessel is shown to have a row of tank assemblies 10, each of which is located in a hold 12 of the ship.

Each tank assembly includes a tank 13 and a material 14 around the outer side of the tank. The tanks 13 are inverted such as are used in aircraft. These tanks include inwardly concaved side walls 15 and rounded upper and lower edges 16 and 17 respectively.

In the present invention, the tanks 13 are sufficiently smaller than the holds into which they fit so that there is approximately a three inch wide space all around the tank, and which is subsequently filled by the material 14 which comprises a sprayed in foam so to fill the space between the bottom 18 of the tank and a floor 19 of the hold and also fell all the space between the side wall 15 of the tank and the bulk heads 12 or sides of the ship. Thus the tanks are supported upon the foam and are prevented from any sideward movement while at a same time air is excluded from around the tanks so to minimize any possibility of fires.

Figure 3:
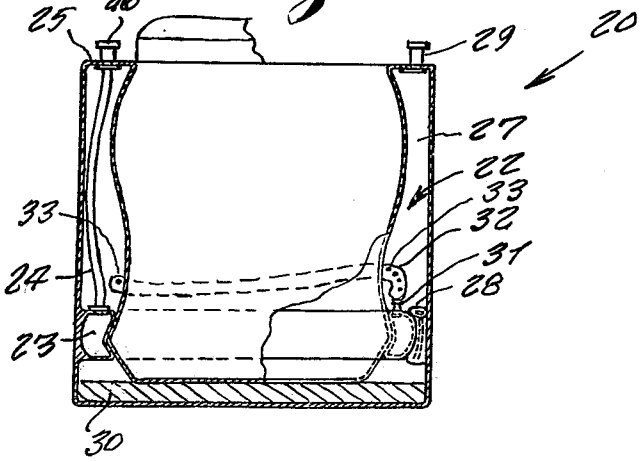
FIG. 3 is a similar view showing a modified design of the invention in which the tank is ringed by an inflated collar filled with inert carbon dioxide or exhaust gas from the ship engines so to produce a cheap and safe support, the collar preventing a sideward sway of the tank.

In FIG. 3, a modified design 20 of the invention is shown wherein a fuel tank 21 ditted in a hold 22 of a ship has a space therebetween in which an inflatable collar 23 rings the tank so to prevent a sideward sway of the tank; the collar being inflatable through a hose 24 leading downward from the weather deck 25 and where it has a removable cap 26 so to be attachable to an exhaust of the ship engine in order to receive exhaust gas. The rest of the hold space 27 can be similarly filled with exhaust gas, and which passes through a stiff sleeve 28 alongside the collar to provide communication with space 27 and the space below the collar. A port closable by a removable cap 29 allows access to the hold sealed space 27. The tank bottom rests upon a pad 30 made of sprayed in foam.

Alternately, a valve 31 can be included on the collar 23, so that a modified design of support for the tank can be obtained wherein a foam is sprayed into the space 27 while exhaust gas is pumped into the collar so that the gas escapes out of the valve and mixes with the foam, thus resulting in a gas-laden foam that provides a physical support while having the characteristics of the exhaust gas that contributes to the safety features of the support by being non-combustible. Thus less foam material is also used, conserving on material. A flexible hose 32 closed on the end and having perforations 33 throughout its length so the gas mixes thoroughly with the foam during the spraying in operation.

Thus a modified design is provided.

While various changes may be made in the detail construction, it is understood that such changes will be within the spirit and scope of the present invention, as is defined by the appended claims.

What is claimed is:

1. A tank assembly for installation inside a hold of an oil tanker vessel, said assembly comprising a fuel tank and a material around said tank that fits in a sealed space between an outer side of said tank, and an inner side of said hold wherein said material comprises an inflatable collar around said tank, said collar being connected by a hose to a capped inlet at a weatherdeck of said vessel, a second capped inlet for communication with said sealed space and a valve on said collar connected to a perforated hose that is closed at its ends, removable caps on both said inlets, said inlet to said collar receiving exhaust gas and said inlet to said space adapted to receive sprayed in foam.

* * * * *